US007658806B2

(12) United States Patent
Jeong et al.

(10) Patent No.: US 7,658,806 B2
(45) Date of Patent: Feb. 9, 2010

(54) DISHWASHER HAVING AVATAR DISPLAY PORTION

(75) Inventors: Seong Hae Jeong, Changwon-si (KR); Byung Hwan Ahn, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 571 days.

(21) Appl. No.: 11/478,356

(22) Filed: Jun. 30, 2006

(65) Prior Publication Data

US 2007/0107754 A1 May 17, 2007

(30) Foreign Application Priority Data

Jun. 30, 2005 (KR) ..... 10-2005-0058249

(51) Int. Cl.
*B08B 3/02* (2006.01)

(52) U.S. Cl. ..... 134/56 D; 134/58 D

(58) Field of Classification Search ..... 134/56 R, 134/113; 135/56 D, 58 D
See application file for complete search history.

(56) References Cited

U.S. PATENT DOCUMENTS

| | | | | |
|---|---|---|---|---|
| 5,983,190 | A * | 11/1999 | Trower et al. | 704/276 |
| 6,342,901 | B1 * | 1/2002 | Adler et al. | 715/700 |
| 6,817,716 | B1 * | 11/2004 | Hines | 353/10 |
| 6,845,486 | B2 * | 1/2005 | Yamada et al. | 715/706 |
| 6,892,143 | B2 * | 5/2005 | Howes et al. | 702/31 |
| 6,934,592 | B2 * | 8/2005 | Hood et al. | 700/83 |
| 7,046,239 | B2 * | 5/2006 | Asai et al. | 345/211 |
| 7,076,504 | B1 * | 7/2006 | Handel et al. | 707/104.1 |
| 7,260,604 | B2 * | 8/2007 | Kuki | 709/205 |
| 7,426,467 | B2 * | 9/2008 | Nashida et al. | 704/275 |
| 7,436,317 | B2 * | 10/2008 | Becke et al. | 340/815.48 |
| 2004/0156170 | A1 * | 8/2004 | Mager et al. | 361/683 |
| 2005/0060746 | A1 * | 3/2005 | Kim | 725/46 |
| 2005/0109070 | A1 * | 5/2005 | Kobayashi et al. | 68/3 R |

FOREIGN PATENT DOCUMENTS

| | | | |
|---|---|---|---|
| JP | 09-84989 | * | 3/1997 |
| JP | 2000-316782 | * | 11/2000 |
| KR | 2002028544 | * | 4/2002 |
| KR | 2003054240 | * | 7/2003 |

OTHER PUBLICATIONS

European Patent Office 0 846 991 Jun. 1998.*

* cited by examiner

*Primary Examiner*—Frankie L Stinson
(74) *Attorney, Agent, or Firm*—McKenna Long & Aldridge LLP

(57) ABSTRACT

A dishwasher having an avatar display portion is provided. The dishwasher includes a tub for housing dishes, a pump for forcing wash water into the tub, a system microcomputer for controlling loads of the dishwasher including the pump and controlling an avatar image display operation, and a display unit including an avatar display portion for displaying a selected avatar image according to an operating state and a load state of the dishwasher under control of the system microcomputer.

13 Claims, 6 Drawing Sheets

DISHWASHER HAVING AVATAR DISPLAY PORTION

This application claims the benefit of Korean Patent Application No. 10-2005-0058249, filed on Jun. 30, 2005, which is hereby incorporated by reference as if fully set forth herein.

BACKGROUND OF THE INVENTION

1. Field of the Invention

The present invention relates to a dishwasher, and more particularly, to a dishwasher having an avatar display portion that improves its information transfer properties by displaying operating and control state information of the dishwasher using an avatar.

2. Discussion of the Related Art

The dishwasher is a device that sprays water into upper and lower racks to wash dishes mounted on each rack.

The following is a description of a conventional dishwasher.

FIG. 1 is a schematic sectional view of the conventional dishwasher.

The dishwasher includes a tub 1, upper and lower spray nozzles 4 and 5, upper and lower racks 6 and 7, and a driver 10.

A wash space in which dishes are washed is formed in the tub 1. The upper and lower nozzles 4 and 5 are provided in the tub 1 at upper and lower inner positions thereof. Dishes to be washed by water sprayed from the upper and lower nozzles 4 and 5 are housed in the upper and lower racks 6 and 7.

The water sprayed from the upper and lower nozzles 4 and 5 is pumped by the driver 10 which includes a sump (not shown) and a wash pump (not shown). Wash water is stored in the sump, and the wash pump pumps the stored water up to the upper and lower nozzles 4 and 5 via upper and lower guide pipes 2 and 3.

FIG. 2 is a block diagram of a control-related structure of the conventional dishwasher.

As shown in FIG. 2, the dishwasher includes a key input unit 11, a water level detector 12, a controller 13, a storage 14, a load driver 15, upper and lower nozzles 16, an alarm sound generator 17, and a display unit 18. The key input unit 11 is used by a user to input a command. The water level detector 12 detects the level of wash water. If the user selects a desired wash cycle and inputs an activation command using the key input unit, then the controller 13 controls the dishwasher to perform the desired wash cycle. During the wash cycle, the controller 13 outputs a control signal according to the water level detected by the water level detector 12 and controls the overall operation of the dishwasher. The load driver 15 controls the operation of loads of the dishwasher. Here, the term "loads" refers to electrical loads rather than wash loads. The alarm sound generator 17 generates a sound indicating an abnormal state of the dishwasher according to a control signal from the controller 13. The display unit 18 displays operating states of the dishwasher. The storage 14 stores a variety of menus and control signals for setting and performing a wash cycle.

Such dishwashers are sold to consumers and are frequently used by consumers in their residences. There have been suggested a variety of means for correctly transferring product information of a dishwasher, which directly affects reliability of its manufacturer and product.

The product information of the dishwasher contains usage of the dishwasher, solutions to problems or errors, and operating state information displayed while the dishwasher is in use. Current home appliance manufacturers generally produce and provide manuals, which describe usage of products, to consumers when they ship the products.

However, the manual is rarely read by the consumer except when a problem occurs in the product. In addition, the manual may fail to provide suitable information when needed due to difficulty in maintaining the manual.

Moreover, to indicate its current operating and control states, the conventional dishwasher merely uses a blinking light or letters displayed on a small screen rather than a large one.

FIG. 3 illustrates an example configuration of a display unit of a conventional dishwasher.

As shown in FIG. 3, the display unit of the dishwasher includes a wash cycle button, a timer washing button, a start/pause button, and the like and also includes an operation display portion for displaying the current wash cycle state, the remaining time, and the like to transfer its product information to the user.

The product information transfer method of the conventional dishwasher has poor information transfer properties since it requires that the user pay attention to the information displayed on the display unit.

In the case of a dishwasher that performs a different type of wash cycle according to user selection, it is required that the dishwasher correctly transfer its current operating states to the user. However, it is difficult for the dishwasher having such a simple display structure to meet this requirement due to its limited display features.

It is also difficult to update the product information of the dishwasher.

SUMMARY OF THE INVENTION

Accordingly, the present invention is directed to a dishwasher having an avatar display portion that substantially obviates one or more problems due to limitations and disadvantages of the related art.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher having an avatar display portion comprises a tub for housing dishes; a pump for forcing wash water into the tub; a system microcomputer for controlling loads of the dishwasher including the pump and controlling an avatar image display operation; and a display unit including an avatar display portion for displaying a selected avatar image according to an operating state and a load state of the dishwasher under control of the system microcomputer. Here, the term "loads" refers to electrical loads rather than wash loads.

Preferably, the display unit further includes an operation display portion for displaying operating state information of the dishwasher, and a screen of the operation display portion and a screen of the avatar display portion are displayed on a single display panel.

Preferably, the avatar image and the operating state information are simultaneously displayed on separate areas on the display panel or are repeatedly and sequentially displayed over an entire area of the display panel.

Preferably, a screen of the operation display portion and a screen of the avatar display portion are displayed on two separate display panels, respectively, and a screen of the avatar display portion is displayed on an LCD panel and a screen of the operation display portion is displayed on an LED panel.

Preferably, the dishwasher further comprises first and second display drivers for driving the avatar display portion and the operation display portion.

Preferably, the system microcomputer controls motion of an avatar according to operating states of the dishwasher including wash, rinse, and dry operating states.

Preferably, the dishwasher further comprises a key input unit having an avatar control key used to input a user selection signal for avatar image processing, an avatar information storage for storing avatars to be displayed on the avatar display portion, and a communication interface block for connection to an external device to download avatar information.

In another aspect of the present invention, a dishwasher having an avatar display portion comprises a tub for housing dishes; a pump for forcing wash water into the tub; a system microcomputer for controlling loads of the dishwasher including the pump; a display microcomputer for controlling an avatar image display operation; and a display unit including an avatar display portion for displaying a selected avatar image according to an operating state and a load state of the dishwasher under control of the display microcomputer.

Preferably, the display microcomputer includes a first controller for controlling a display operation of the avatar display portion and a second controller for controlling a display operation of the operation display portion.

The dishwasher having the avatar display portion according to the present invention has a variety of advantages.

For example, operating and control state information of the dishwasher and basic usage of the dishwasher can be displayed using a dynamic (or animated) character.

This improves visibility of such information and thus improves the information transfer properties and also can emphasize its entertainment aspects according to the current trend of consumers.

Especially, since the motion of the selected avatar is controlled according to changes in wash, rinse, dry cycle states of the dishwasher and operating states of the pump and other load drivers, the user can accurately determine the current operating state of the dishwasher in a short time.

The dishwasher also can provide a variety of representations of such information by connecting to a server using an external device and then downloading and storing new avatars from the server.

This makes it possible to display a variety of operating states according to operating conditions of the dishwasher and thus to increase the competitiveness of the product.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to preferred embodiments of a dishwasher having an avatar display portion according to the present invention, examples of which are illustrated in the accompanying drawings. Wherever possible, the same reference numbers will be used throughout the drawings to refer to the same or like parts.

Figure 1:
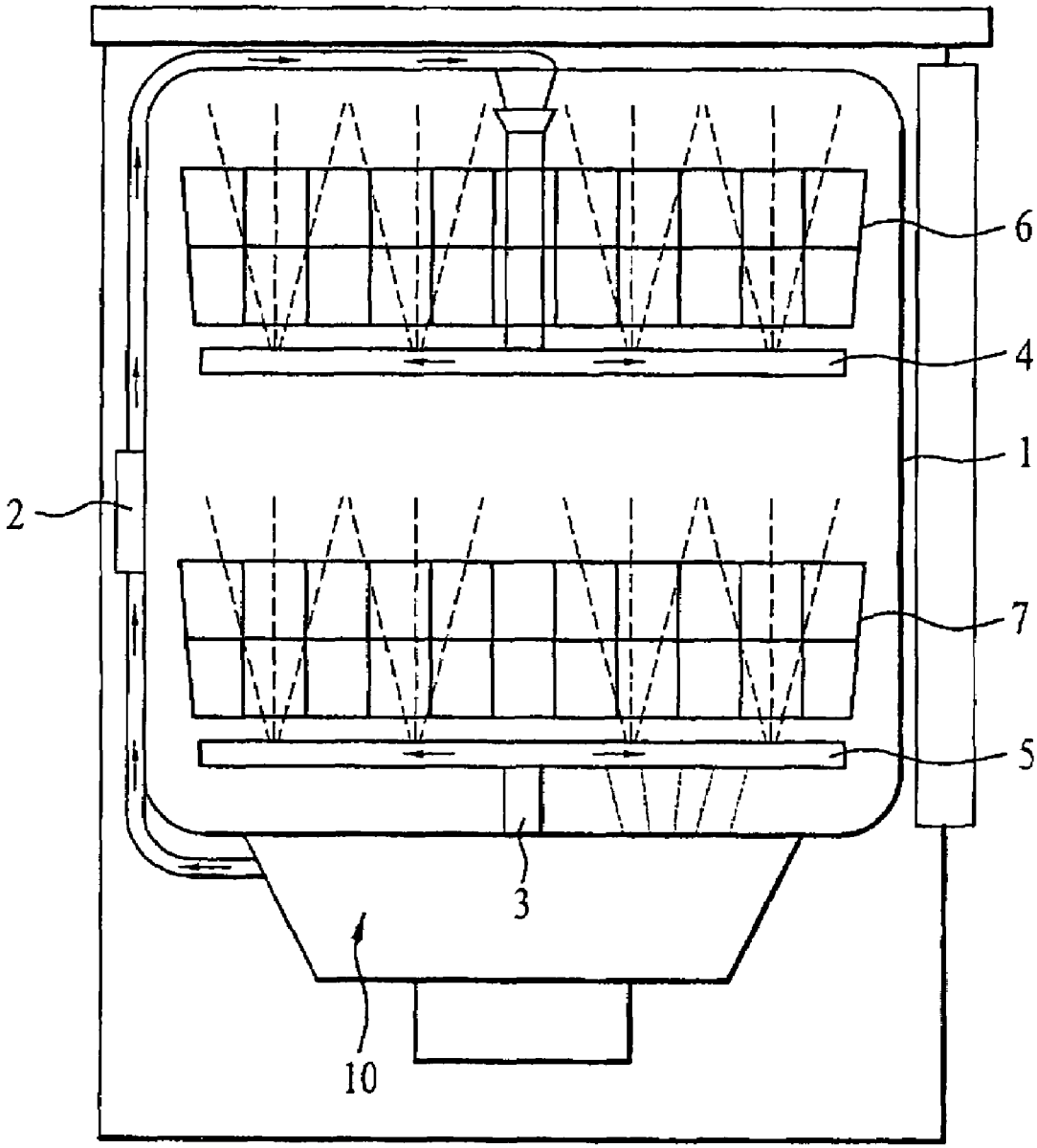
FIG. 1 is a schematic sectional view of a conventional dishwasher.
Figure 2:
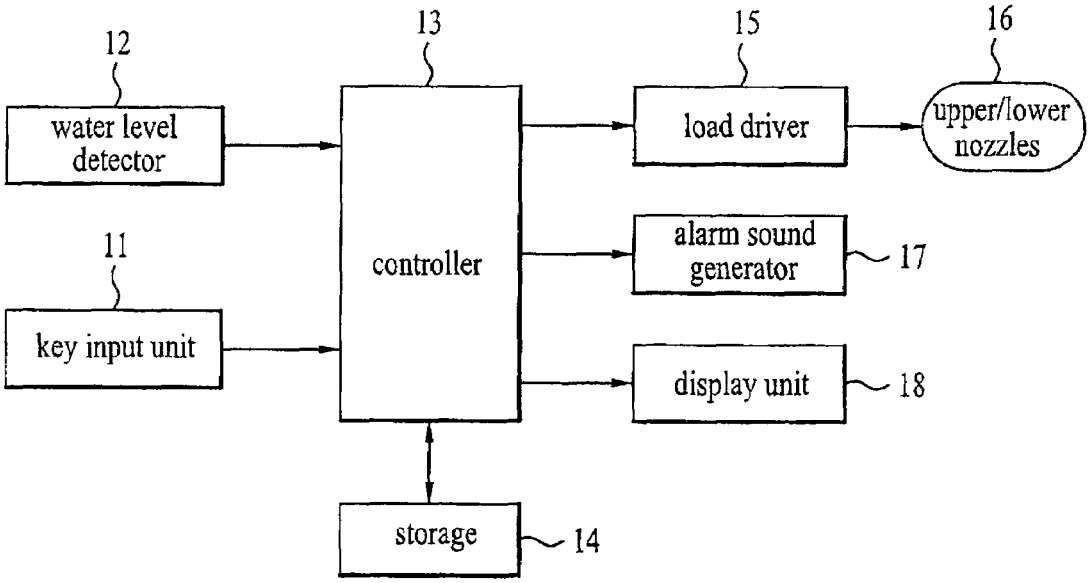
FIG. 2 is a block diagram of the conventional dishwasher.
Figure 3:
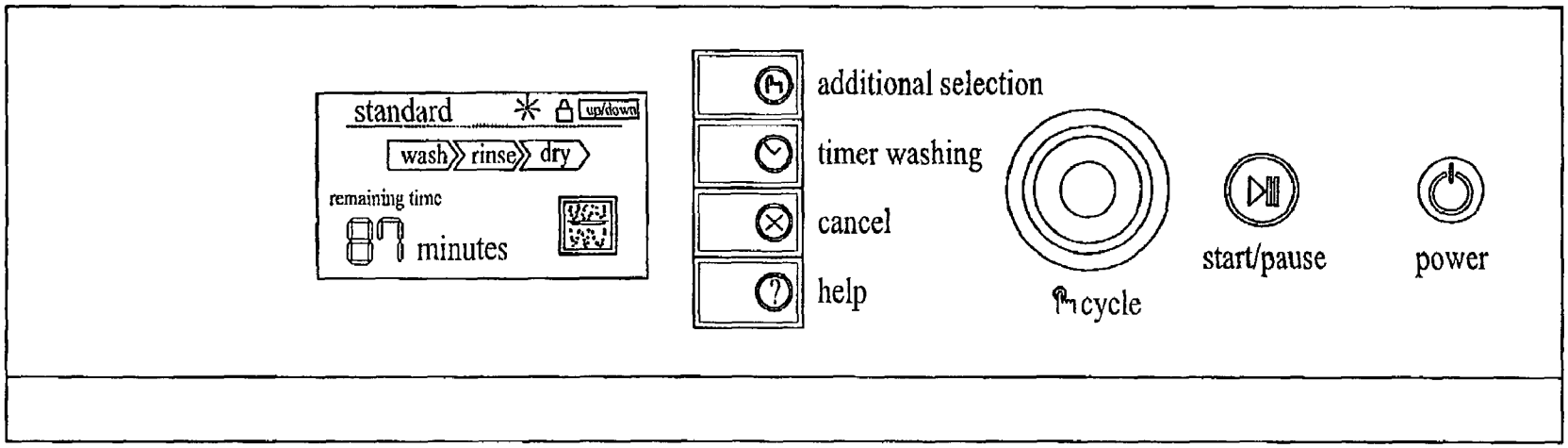
FIG. 3 illustrates an example configuration of a display unit of the conventional dishwasher.
Figure 4:
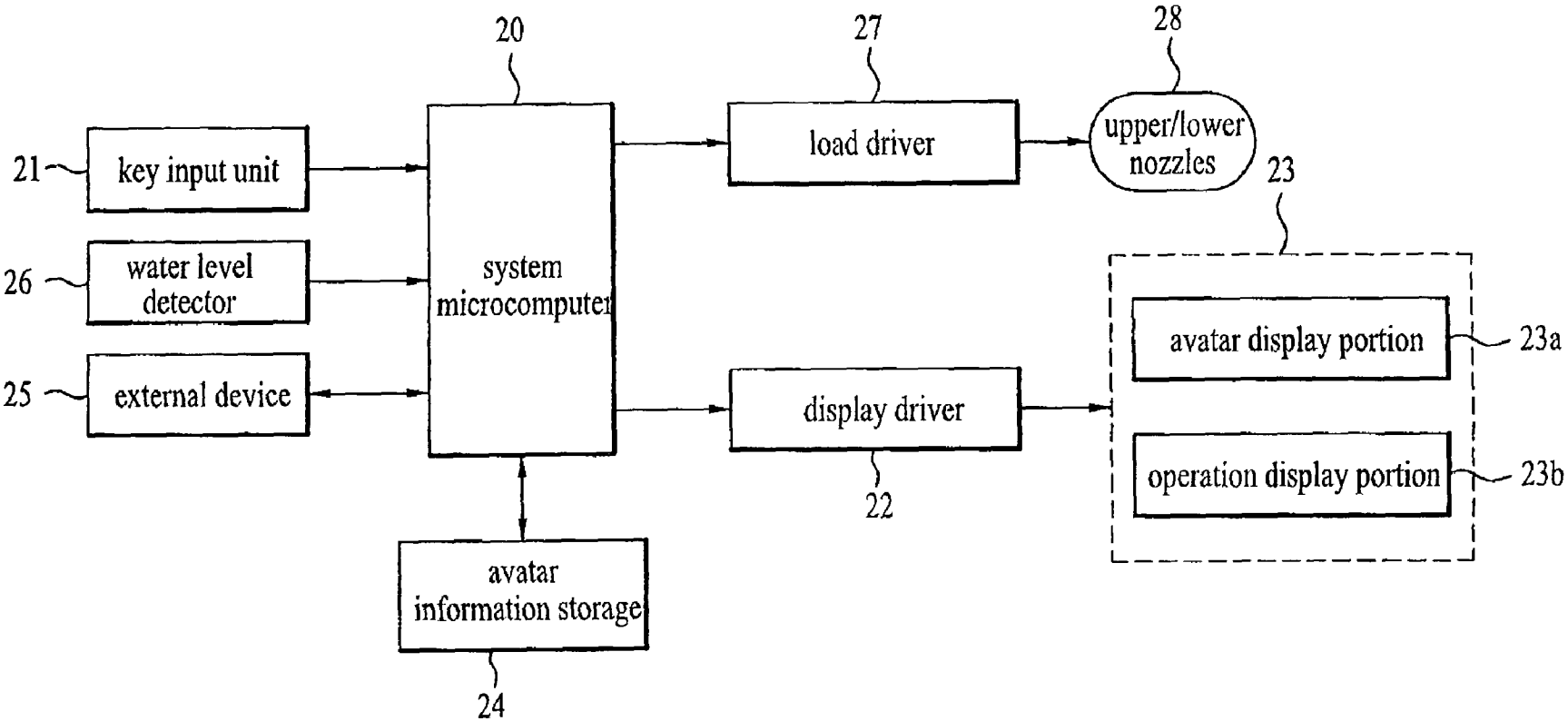
FIG. 4 is a block diagram of a dishwasher having an avatar display portion according to a first embodiment of the present invention.
Figure 5:
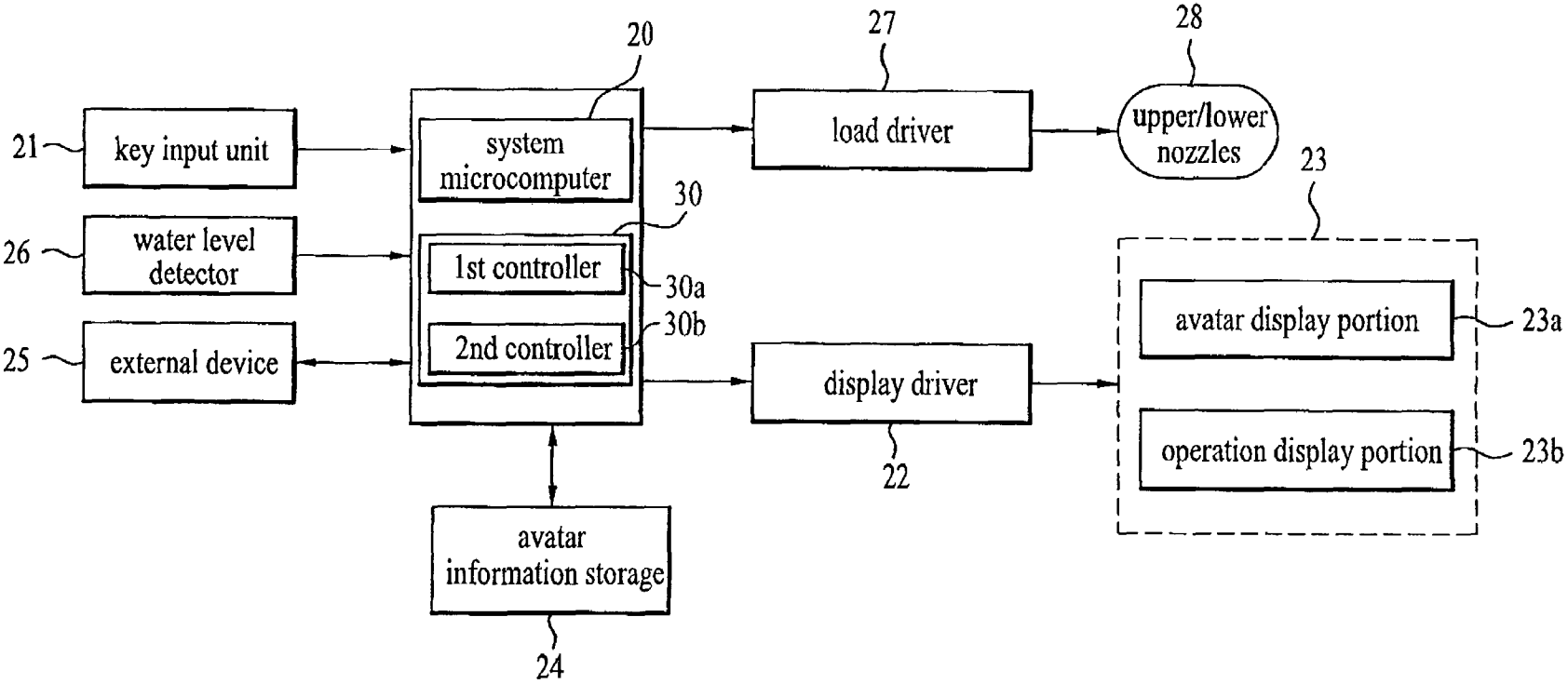
FIG. 5 is a block diagram of a dishwasher having an avatar display portion according to a second embodiment of the present invention.

FIG. 4 is a block diagram of a dishwasher having an avatar display portion according to a first embodiment of the present invention and FIG. 5 is a block diagram of a dishwasher having an avatar display portion according to a second embodiment of the present invention.

Figure 6:
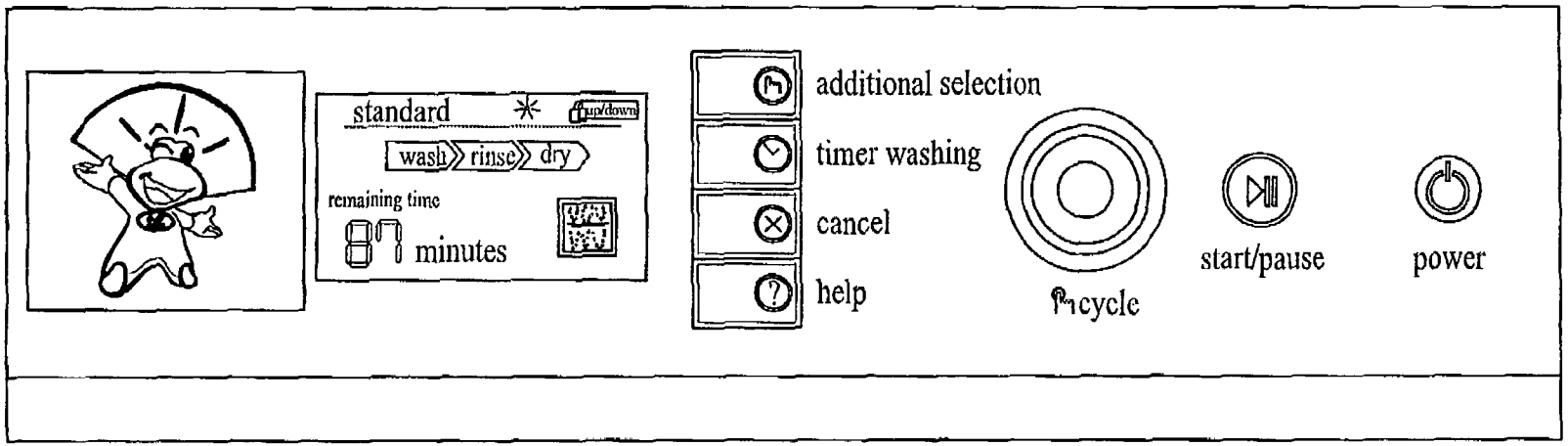
FIG. 6 illustrates an example configuration of a display unit of a dishwasher having an avatar display portion according to the present invention.

FIG. 6 illustrates an example configuration of a display unit of a dishwasher having an avatar display portion according to the present invention.

The present invention is applied to a dishwasher wherein a three-dimensional character (i.e., an avatar) is used to display usage and operating states of the dishwasher, thereby improving visibility of such information and thus improving the information transfer properties.

An audio output device (not shown) may be used to output a sound explaining basic usage of the dishwasher while the avatar serves as a helper.

The avatar-based information transfer method not only can improve visibility of the information but also can emphasize its entertainment aspects according to the current trend of consumers.

The term "avatar" is originally used to describe an incarnation or embodiment of God and is now commonly used to describe an animated character that represents a user in cyberspace. Internet users mostly use their avatars as graphic icons that represent them in a three-dimensional or virtual reality game or web chatting.

That is, an avatar of a user can be considered a virtual body representing the user in graphic-based virtual environments. Avatars are not only used in fields such as chatting or online games but are also spreading to fields such as a cyber shopping mall, virtual education, and virtual office.

The present invention provides a dishwasher having an avatar display portion, wherein an avatar is selected as an entity that functions as a helper in an information transfer process and also functions to transfer information by itself.

The avatar according to the present invention has a specific motion in a manner that can specify a specific operation of the dishwasher or has a form to transfer specific information.

The dishwasher having an avatar display portion according to the present invention mainly includes a system microcomputer used as a main controller of the dishwasher, a display microcomputer used to control a display operation of an operating state of the dishwasher and to control a display operation of an avatar that has an independent motion or a motion associated with the operating state, an avatar display portion and an operation display portion for processing and displaying an avatar image under control of the display microcomputer, and a storage in which avatar-related information is stored.

The display microcomputer includes a first controller for controlling the avatar display portion and a second controller for controlling the operation display portion, thereby achieving more efficient control of each of the display portions.

In another embodiment, the display microcomputer may not be provided and instead the system microcomputer may be designed to control the overall operation of the dishwasher and also to control an avatar-related image processing operation of an avatar type selected by the user according to the type of displayed information and the operating state of the dishwasher.

FIG. 4 illustrates the first embodiment of the present invention wherein the system microcomputer is designed to control the operation of the dishwasher and also to control an avatar display operation of the dishwasher.

The dishwasher includes a tub (not shown), a system microcomputer 20, a key input unit 21, a display driver 22, a display unit 23, an avatar information storage 24, a water level detector 26, a load driver 27, and upper and lower spray nozzles 28. The upper and lower spray nozzles 28 spray wash water into the tub in which dishes are housed. The system microcomputer 20 applies a control signal to the load driver 27, such as a pump (not shown) used to force wash water into the tub, to perform dish washing according to a set wash cycle. The system microcomputer 20 also controls an avatar-related image processing operation of an avatar type selected by the user according to the type of displayed information and the operating state of the dishwasher. The key input unit 21 includes a key input means for allowing the user to select a command such as a command to set a wash cycle and avatar control keys for inputting a user selection signal for avatar image processing through the system microcomputer 20, for example, an avatar selection/cancellation signal. The water level detector 26 detects the level of water for washing dishes. The display driver 22 outputs a drive signal for displaying a menu used when selecting an operation for washing dishes, current status information, and an avatar image. The display unit 23 displays a menu used when selecting an operation for washing dishes, current status information, or an avatar image according to a drive signal from the display drive unit 22. The avatar information storage 24 stores various types of avatar image information.

The display unit 23 includes an avatar display portion 23*a* for displaying an avatar image and an operation display portion 23*b* for displaying operating states of the dishwasher such as an operating mode and a remaining time.

The avatar display portion 23*a* and the operation display portion 23*b* may be constructed using a single display panel or may be constructed using two separate display panels, respectively.

When the avatar display portion 23*a* and the operation display unit 23*b* are constructed using two separate display panels, for example, the avatar image display portion 23*a* is constructed using a liquid crystal display (LCD) panel and the operation display portion 23*b* is constructed using a light emitting diode (LED) or luminescent diode panel.

When the avatar display portion 23*a* and the operation display portion 23*b* are constructed using a single display panel, for example, an avatar image part and an operation display part are simultaneously displayed on separate areas on the single display panel or are displayed sequentially according to user selection.

The background color of the screen of the display unit 23 may be changed to various colors according to user selection.

The dishwasher having the avatar display portion according to the present invention further includes a communication interface block (not shown) through which the system microcomputer 20 connects to an external device 25 such as a PC, a wireless notebook computer, or a mobile phone connected to a wireless network to download and store avatar information in the avatar information storage 24.

When the dishwasher has a function to wirelessly connect to a home network, the dishwasher may search for, download, and store avatar information without using a connection cable.

FIG. 5 illustrates the second embodiment of the present invention wherein a controller of the dishwasher is divided into a system microcomputer for controlling the operation of the dishwasher and a display microcomputer for controlling an avatar display operation of the dishwasher.

The dishwasher includes a tub (not shown), a system microcomputer 20, a display microcomputer 30, a key input unit 21, a display driver 22, a display unit 23, an avatar information storage 24, a water level detector 26, a load driver 27, and upper and lower spray nozzles 28. The upper and lower spray nozzles 28 spray wash water into the tub in which dishes are housed. The system microcomputer 20 applies a control signal to the load driver 27, such as a pump (not shown) used to force wash water into the tub, to perform dish washing according to a set wash cycle. The display microcomputer 30 controls an avatar-related image processing operation of an avatar type selected by the user according to the type of displayed information and the operating state of the dishwasher. The key input unit 21 includes a key input means for allowing the user to select a command such as a command to set a wash cycle and avatar control keys for inputting a user selection signal for avatar image processing through the display microcomputer 30, for example, an avatar selection/cancellation signal. The water level detector 26 detects the level of water for washing dishes. The display driver 22 outputs a drive signal for displaying a menu used when selecting an operation for washing dishes, current status information, and an avatar image. The display unit 23 displays a menu used when selecting an operation for washing dishes, current status information, or an avatar image according to a drive signal from the display drive unit 22. The avatar information storage 24 stores various types of avatar image information.

The display unit 23 includes an avatar display portion 23*a* for displaying an avatar image and an operation display portion 23*b* for displaying operating states of the dishwasher such as an operating mode and a remaining time.

The avatar display portion 23*a* and the operation display portion 23*b* may be constructed using a single display panel or may be constructed using two separate display panels, respectively.

When the avatar display portion 23*a* and the operation display unit 23*b* are constructed using two separate display panels, for example, the avatar image display portion 23*a* is constructed using a liquid crystal display (LCD) panel and the operation display portion 23*b* is constructed using light emitting diodes (LEDs) or luminescent diodes.

When the avatar display portion 23*a* and the operation display portion 23*b* are constructed using a single display panel, for example, the avatar display portion 23*a* and the operation display portion 23*b* are displayed at the same time on separate regions of the single display panel or are displayed sequentially according to user selection.

The background color of the screen of the display unit 23 may be changed to various colors according to user selection.

The display microcomputer 30 is divided into a first controller 30*a* for controlling a display operation of the avatar display portion 23*a* for displaying an avatar image and a second controller 30*b* for controlling a display operation of the operation display portion 23*b* for displaying operating states of the dishwasher such as an operating mode and a remaining time.

In this case, the display driver 22 is preferably divided into a first display driver for driving the avatar display portion 23*a* and a second display driver for driving the operation display portion 23*b*.

The purpose of the division of the display driver is to improve the driving characteristics of the avatar display portion 23*a* and the operation display portion 23*b*.

The dishwasher having the avatar display portion according to the present invention further includes a communication interface block (not shown) through which the system microcomputer 20 connects to an external device 25 such as a PC, a wireless notebook computer, or a mobile phone connected to a wireless network to download and store avatar information in the avatar information storage 24.

FIG. 6 illustrates an example configuration of the display unit of the dishwasher having the avatar display portion according to the present invention.

In the example of FIG. 6, an avatar display portion 23*a* and an operation display portion 23*b* are constructed using a single display panel.

When the system microcomputer 20 has connected to the external device 25 according to a user selection made through the key input unit 21, the system microcomputer 20 performs an operation for searching for a desired avatar and creating a new avatar. When the search and creation operation is finished, the system microcomputer 20 downloads corresponding avatar information according to a user selection and stores the downloaded avatar information in the avatar information storage 24.

Various types of avatars are stored in the avatar information storage 24. The user can select an avatar corresponding to a specific operating state or a specific cycle from the stored avatars using the key input unit 21.

The selected avatar is displayed while its motion is controlled according to changes in wash, rinse, dry cycle states of the dishwasher and operating states of the pump and other load drivers.

Such avatar information can be searched for and created according to various methods as follows.

In one method, an external device is connected to a server, which provides avatars, via a network such as the Internet, a desired avatar is searched for in the server or a new avatar is created through the server, the found or created avatar is stored in the external device, and the stored avatar is downloaded to the avatar information storage 24 using the key input unit 21 of the dishwasher.

In another method, an external device is connected to a server operated by a dishwasher manufacturer rather than the server which provides avatars, a desired avatar is searched for in the connected server or a new avatar suited to the user's preferences is created through the server, the found or created avatar is stored in the external device, and the stored avatar is downloaded to the avatar information storage 24 using the key input unit 21 of the dishwasher.

Instead of using an external device for the search and creation, the dishwasher may be directly connected to an external server using the key input unit 21 so that an avatar can be searched for, created, and stored while viewing information displayed on the display unit 23.

To accomplish this, the system microcomputer 20 or the display microcomputer 30 stores therein a program which allows an avatar image contained in the downloaded avatar information to be optimally displayed according to control or operating states of the dishwasher.

The program can be updated by connecting to the server operated by the manufacturer and downloading updates from the server.

The user selects an avatar from the avatars stored in the avatar information storage 24 using the key input unit 21 and the selected avatar is displayed while its color, shape, and moving form is changed according to operating states of the dishwasher.

In addition, a different type of avatar can be selected according to the type of displayed information and operating and control state information of the dishwasher and basic usage of the dishwasher can be displayed using a dynamic (or animated) character.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dishwasher having an avatar display portion, the dishwasher comprising:

a tub for housing dishes;

a pump for forcing wash water into the tub;

a system microcomputer for controlling loads of the dishwasher including the pump;

a display unit including:

an avatar display portion for displaying a selected avatar image according to an operating state and a load state of the dishwasher under control of the system microcomputer;

an operation display portion for displaying operating state information of the dishwasher;

a display microcomputer for controlling an avatar image display operation, wherein the display microcomputer further includes a first controller for controlling a display operation of the avatar display portion and a second controller for controlling a display operation of the operation display portion; and a display driver including a first display driver for driving the avatar display portion and a second display driver for driving the operation display portion.

2. The dishwasher according to claim 1, wherein a screen of the operation display portion and a screen of the avatar display portion are displayed on a single display panel.

3. The dishwasher according to claim 2, wherein the avatar image and the operating state information are simultaneously displayed on separate areas on the display panel or are repeatedly and sequentially displayed over an entire area of the display panel.

4. The dishwasher according to claim 1, wherein a screen of the operation display portion and a screen of the avatar display portion are displayed on two separate display panels, respectively.

5. The dishwasher according to claim 1, wherein a screen of the avatar display portion is displayed on an LCD panel and a screen of the operation display portion is displayed on an LED panel.

6. The dishwasher according to claim 1, wherein the the first controller and the first display driver control motion of an avatar according to operating states of the dishwasher including wash, rinse, and dry operating states.

7. The dishwasher according to claim 6, wherein the the first controller and the first display driver control motion of an avatar according to changes in operating states of loads of the dishwasher including the pump.

8. The dishwasher according to claim 1, further comprising a key input unit having an avatar control key used to input a user selection signal for avatar image processing.

9. The dishwasher according to claim 1, further comprising an avatar information storage for storing avatars to be displayed on the avatar display portion.

10. The dishwasher according to claim 1, wherein avatar information is downloaded using a wireless connection function.

11. The dishwasher according to claim 10, wherein the avatar information is searched for or created according to a user selection.

12. The dishwasher according to claim 1, further comprising a communication interface block for connection to an external device to download avatar information.

13. The dishwasher according to claim 12, wherein the avatar information is searched for or created according to a user selection.

* * * * *